US006419587B1

(12) United States Patent
Geyer

(10) Patent No.: US 6,419,587 B1
(45) Date of Patent: Jul. 16, 2002

(54) REVERSIBLE SLIDE/CLIMBER PLAYGROUND EQUIPMENT

(75) Inventor: Kathleen A. Geyer, Aurora, MO (US)

(73) Assignee: Miracle Recreation Equipment Company, Monett, MO (US)

( * ) Notice: Subject to any disclaimer, the term of this patent is extended or adjusted under 35 U.S.C. 154(b) by 0 days.

(21) Appl. No.: 09/641,493

(22) Filed: Aug. 18, 2000

(51) Int. Cl.[7] ..... A63G 21/00
(52) U.S. Cl. ..... 472/116; 482/35
(58) Field of Search ..... 472/116, 117, 472/88, 90; 482/35, 36, 37, 52

(56) References Cited

U.S. PATENT DOCUMENTS

| | | | | |
|---|---|---|---|---|
| 2,620,185 A | * | 12/1952 | Harding | 472/116 |
| 3,561,757 A | | 2/1971 | Schillig | |
| D262,818 S | | 1/1982 | Works | |
| 4,546,965 A | * | 10/1985 | Baxter et al. | 472/116 |
| D281,892 S | | 12/1985 | Addleman | |
| D284,021 S | | 5/1986 | Addleman | |
| D303,826 S | | 10/1989 | Aker | |
| 5,554,074 A | * | 9/1996 | Von Parish | 472/116 |
| D375,537 S | | 11/1996 | Lenihan | |
| D377,203 S | | 1/1997 | Jaeb | |
| 5,688,180 A | * | 11/1997 | Siragusa, Jr. et al. | 472/116 |
| 5,941,041 A | * | 8/1999 | Robinson et al. | 52/591.4 |
| 6,193,633 B1 | * | 2/2001 | Jonas et al. | 482/35 |

* cited by examiner

*Primary Examiner*—Kien T. Nguyen
(74) *Attorney, Agent, or Firm*—Polster, Lieder, Woodruff & Lucchesi

(57) ABSTRACT

A reversible slide/climber playground equipment for children is disclosed. The slide/climber has generally opposed formed surfaces, one a sliding surface and the other a climbing surface. The slide/climber is reversible so as to utilize one of the opposed surface at a particular time, the utilized surface facing generally upward while the non-utilized surface faces generally downward. The slide surface may include slide paths which have a bottom contour with a mogul pattern and may deviate from parallel to the center line of the inclined portion. Each slide path is defined by a sidewall so as to separate the slide paths. For the climbing surface, adjacent steps may be provided. The adjacent steps may be irregularly shaped and interconnected. The slide/climber includes a depression for receiving a support leg when the slide paths are facing generally downward. The support leg in the center of the inclined portion is telescoping to facilitate use of the slide/climber for its intended function as either a slide or climber.

22 Claims, 11 Drawing Sheets

REVERSIBLE SLIDE/CLIMBER PLAYGROUND EQUIPMENT

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

Children are eternally curious and love to play. Children constantly seek new and various stimulants, both intellectually and physically. Games are invented with whatever kids find at hand, and everything can become a play toy. In addition, children are attracted to playground equipment that looks fun to play on, and equipment that is not complicated to use.

Children have long enjoyed playground equipment allowing for sliding and climbing. Traditionally, a slide has simply been a slide, and a climbing apparatus has simply allowed for climbing. As each piece of equipment has been single-purposed, providing a slide and a climbing apparatus has typically required multiple pieces. Thus, a separate slide or a separate climber each has required its own area for use.

In addition, most slides and climbing equipment are limited in the number of children that may physically be present on the equipment at a single moment. Playground equipment that allows multiple children to play simultaneously is desired.

The present invention relates to sliding and climbing playground equipment. As compared to existing prior art slides and climbers, the present invention provides playground equipment that is both a slide and a climber. Thus, the present invention provides a unique design for playground equipment and overcomes the discussed problems of prior art designs.

BRIEF SUMMARY OF THE INVENTION

Among the several objects and advantages of the present invention include:

- the provision of a slide and a climbing apparatus in a single unit;
- the provision of a reversible slide and climber;
- the provision of a slide and climbing apparatus that minimizes the area required for its use;
- the provision of a slide and climbing apparatus that allows multiple children to play at the same time;
- the provision of a slide and climbing apparatus that is attractive to children; and
- the provision of a slide and climbing apparatus that is simple to use.

These and other objects and the advantages of the present invention will become more apparent from the description that follows.

In accordance with these objects, the invention is playground equipment for the dual function of sliding and climbing. The invention includes a horizontal platform and an inclined portion attached thereto and extending to the ground. The inclined portion is supported approximately midway between the horizontal platform and the ground by detachable and re-attachable legs. The inclined portion of the combined slide/climber has two, generally opposed formed surfaces, a slide surface and a climbing surface. For one use, the inclined portion presents a slide surface, while when reversed in another use, the inclined portion presents a climber surface. The slide surface includes multiple, defined sliding paths that may be regular or irregular and may include humps or moguls. The climber surface includes multiple, defined climbing paths that may be regular or irregular. As the slide/climber is reversible, children may use one of the surfaces at a particular time. Each surface is on an opposite side of the inclined portion such that either the slide surface or the climbing surface is generally facing upward at a particular time to satisfy a particular function of the invention while the other surface is generally facing downward. Several different slide and climber surfaces are disclosed to show the scope and extent of the present invention. The horizontal platform is supported parallel to and above the ground by posts extending from the ground level to above the horizontal platform further supporting a roof.

BRIEF DESCRIPTION OF THE SEVERAL VIEWS OF THE DRAWINGS

In the drawings.

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

There are three illustrated embodiments of the present invention shown in FIGS. 1–5; 6–10 and 11–13 which will be discussed in detail below.

Figure 1B:
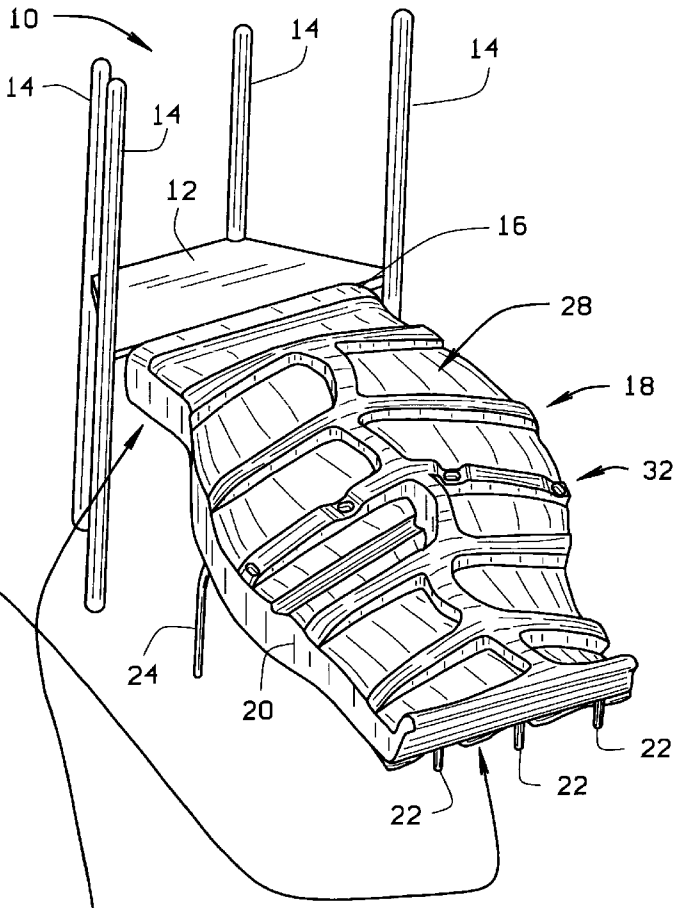
FIG. 1 is two perspective views of one embodiment of the invention showing how the invention is reversible as to provide each function of the invention as a slide or climber.
Figure 1A:
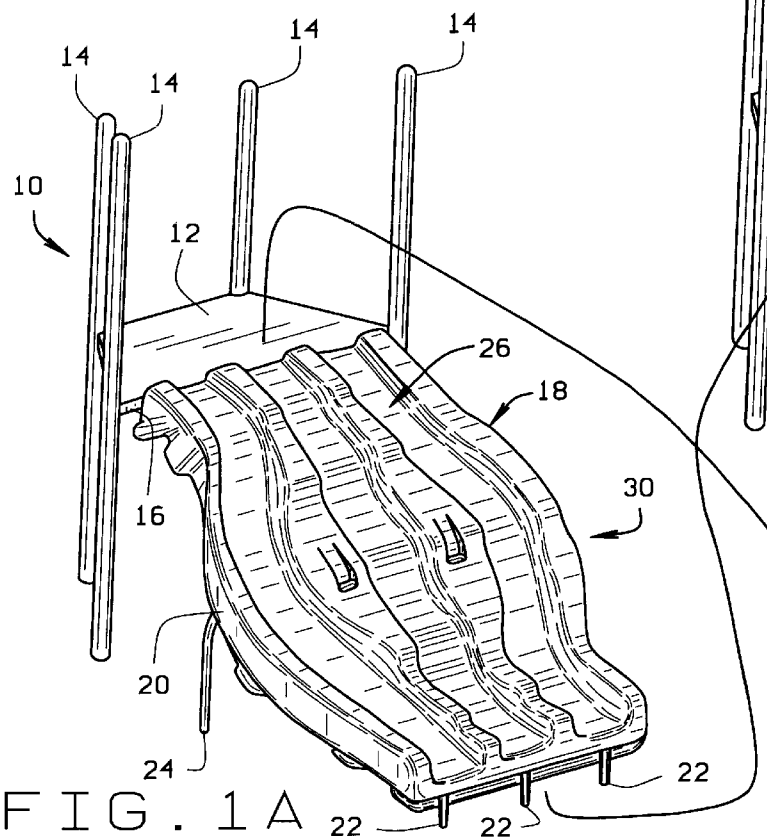

Referring initially to the embodiment shown in FIGS. 1–5, a reversible slide/climber 10 is depicted in FIG. 1. The slide/climber 10 includes a horizontal platform 12 generally parallel to the ground or support surface and is supported by four posts 14, though this number may vary depending on the geometry of the horizontal platform 12. The horizontal platform 12 and posts 14 can support the weight of several children simultaneously. The bottom of each post 14 rests on the ground or support surface and extends platform 12. In the present embodiment, the horizontal platform 12 has four edges around its perimeter, one of which is referred to herein as the horizontal platform edge 16.

The horizontal platform edge 16 abuts and connects to an elongated member identified as the inclined portion 18. The inclined portion 18 extends downward from the horizontal platform edge 16 and approaches the ground or support surface. The profile 20 of the inclined portion 18 is generally of an S-shape. The inclined portion 18 is supported at its lower-most portion by peg legs 22. The inclined portion 18 is supported in the center by two support legs 24, further discussed below and depicted in FIGS. 4 and 5. The inclined portion 18 has two, generally opposed formed surfaces, a sliding surface 26 and a climbing surface 28 on opposing sides of the inclined portion 18. The inclined portion 18 is reversible so that, in use, either surface 26, or 28 is generally facing upward while the other is generally facing downward.

The sliding surface 26 permits use of the slide/climber 10 as a slide and the climbing surface 28 permits use of the slide/climber 10 as a climber. When the inclined portion 18 is serving one purpose, one end of the inclined portion 18 abuts the horizontal platform edge 16, and the other end of the inclined portion 18 rests on the peg legs 22. When the configuration of the inclined portion 18 is changed as to serve the other purpose, the ends of the inclined portion 18 are reversed, as depicted by the arrows in FIG. 1. In addition, the surface 26 or 28 facing generally upward is reversed.

As the configuration of the inclined portion 18 may be changed, the slide/climber 10 provides both a slide 30 and a climber 32. This provides for a variety of exercises for children in a single unit. Additionally, being a single unit, the slide/climber 10 minimizes the amount of space required for both a slide 30 and a climber 32. Being generally stationary, and being limited only by the imagination of children in finding ways to climb or slide, the slide/climber 10 is simple to use.

Figure 2:
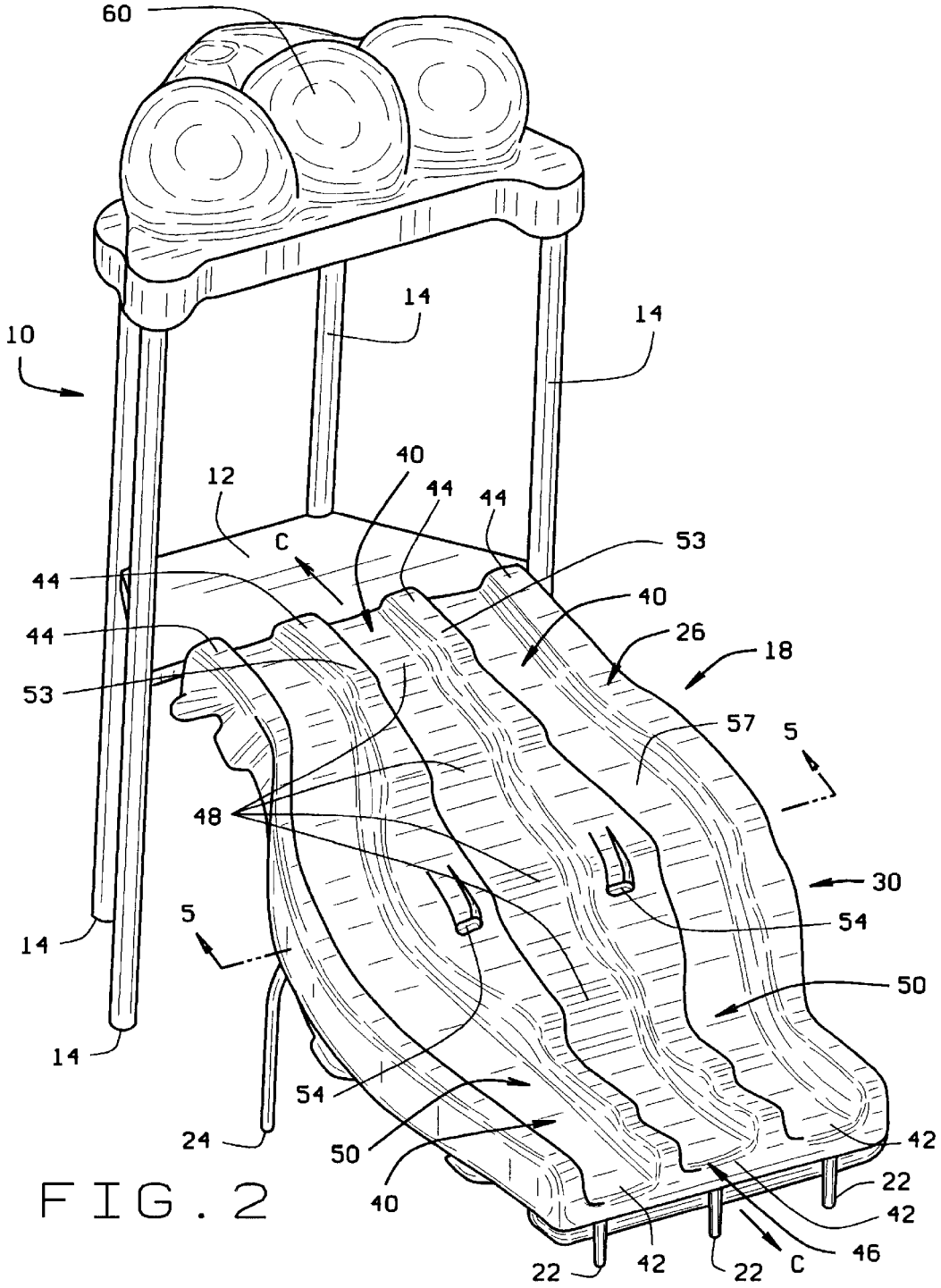
FIG. 2 is an enlarged perspective view of the invention showing the sliding purpose of the invention.

Referring to FIG. 2, the slide/climber 10 is depicted with the sliding surface 26 of the inclined portion 18 generally facing upward and providing a slide 30. As depicted, the sliding surface 26 has a plurality of adjacent slide paths 40. Each slide path 40 is defined by a bottom contour 42 and upstanding sidewalls 44. In the present embodiment, there are three slide paths 40, a center slide 46 having a bottom contour 42 including a plurality of moguls 48 and two side slides 50, 50 having a generally smooth bottom contour 42. The sidewalls 44 separate the slide paths 40. Each of the two middle sidewalls 53, 53 have a depression 54 designed so as to receive a support leg 24 when the sliding surface 26 is generally facing downward. The plurality of slide paths 40 allows multiple children to play on the slide/climber 10 simultaneously.

The slide path 40 of the center slide 46 from the horizontal platform 12 towards the ground or support surface is generally straight. The slide path 40 of the side slides 50, 50 is S-shaped so that the center portion of the slide path 40 is extended away from the centerline C of the sliding surface 26. As each slide path 40 is different and at least one has a bottom contour 42 differing from the others, the sliding surface 26 provides variety in the activity of sliding, thereby creating greater interest and stimulation for children. Additionally, the variety makes the slide/climber 10 attractive to children while remaining simple to use.

Further depicted in FIG. 2 is a roof 60. The roof 60 is supported by the aforementioned posts 14. The roof 60 is positioned at a height sufficient as to allow children to stand upright underneath the roof 60 and, preferably as a safety precaution, at a height sufficient to prevent children from attempting to climb atop the roof 60. As depicted, the roof 60 has a decorative shape as to be pleasing and attractive to children.

Figure 3:
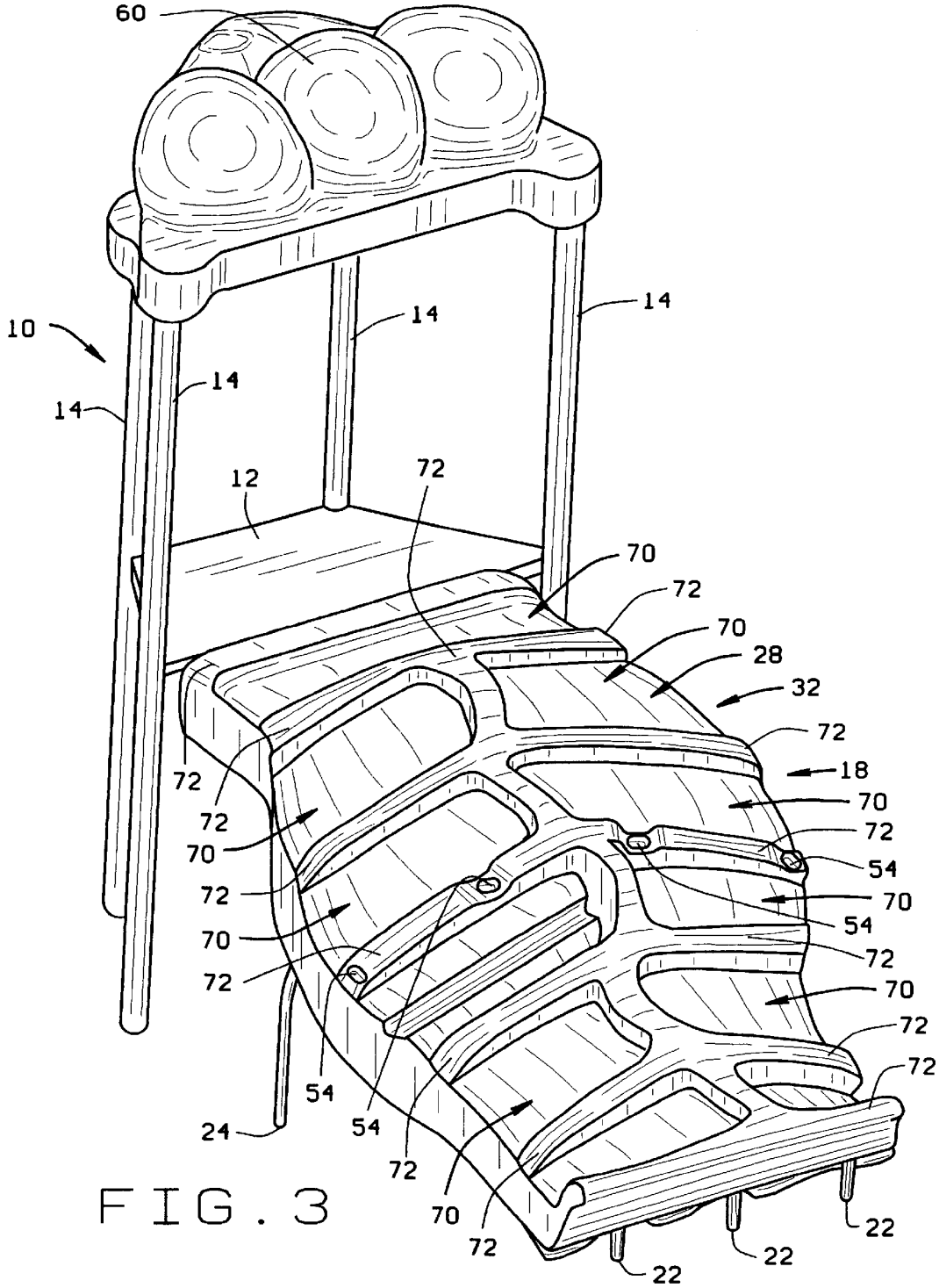
FIG. 3 is an enlarged perspective view of the invention showing the climbing purpose of the invention.

Referring to FIG. 3, the slide/climber 10 is shown with the climbing surface 28 of the inclined portion 18 generally facing upward and providing a climber 32. The climbing surface 28 includes one or more series of adjacent steps 70. Each step 70 is defined by a hollow formed by protrusions 72 extending generally upward from the climbing surface 28, the protrusions 72 allowing a user to move his or her body either up or down the inclined portion 18. As children enjoy variety, the steps 70 are irregularly configured, as well as interconnected as to allow the steps 70 to be adjoined and divided by the protrusions 72. The climbing surface 28 further includes depressions 54 designed to receive a support leg 24 when the climbing surface 28 is generally facing downward. Preferably, these depressions 54 are located on a protrusion 72, as depicted. As further depicted, the preferable embodiment provides space for multiple children to climb the climbing surface 28 simultaneously. Furthermore, the irregularly shaped steps 70 are designed as to be attractive to children.

Figure 4:
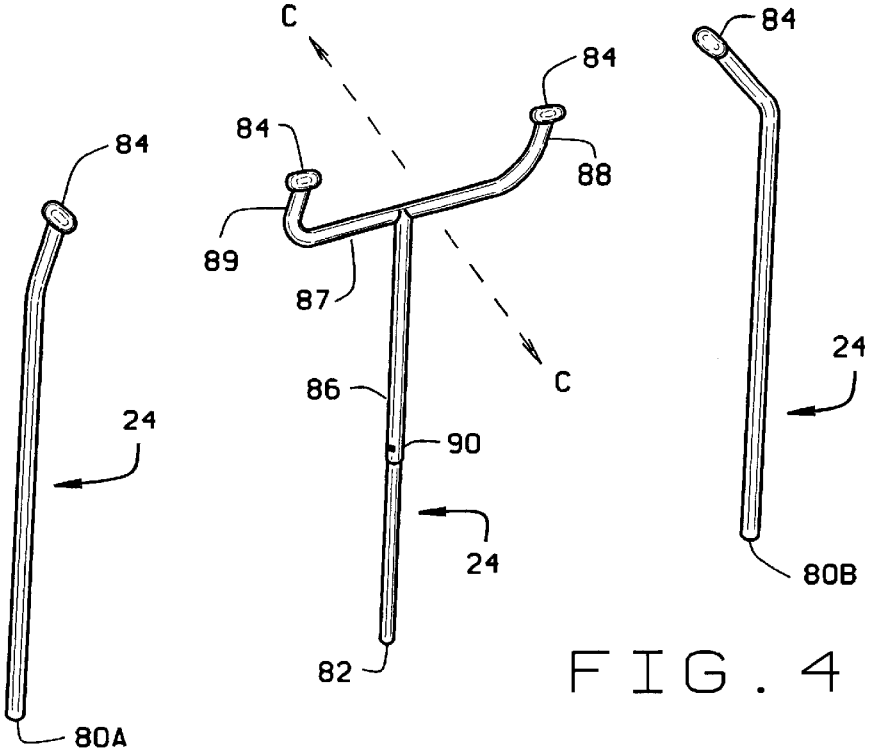
FIG. 4 is a perspective view of the support legs for the inclined portion of the invention.

FIG. 4 depicts the support legs 24. In the FIGS. 1–5 embodiment, the support legs 24 include two outside legs 80A, 80B and a center stanchion 82. Each outside leg 80A, 80B is generally vertical, with the upper-most portion angled toward the centerline C of the inclined portion 18. The top end of each outside leg 80A, 80B has a support plate 84 which connects to the aforementioned depressions 54 in the surfaces 26, 28 of the inclined portion 18. The center stanchion 82 has a pole 86, and a cross-bar 87, which is orthogonal to the centerline C, the cross-bar 87 being turned upward at a right angle to provide for two uprights 88 which form a line orthogonal to the centerline C. The cross-bar 87 is supported by the pole 86, the bottom of which rests on the ground or support surface. Each upright 88 terminates at a support plate 84 connecting to the aforementioned depressions 54 in the surfaces 26, 28 of the inclined portion 18. The bottom of each support leg 24 rests on the ground or support surface.

Figure 5:
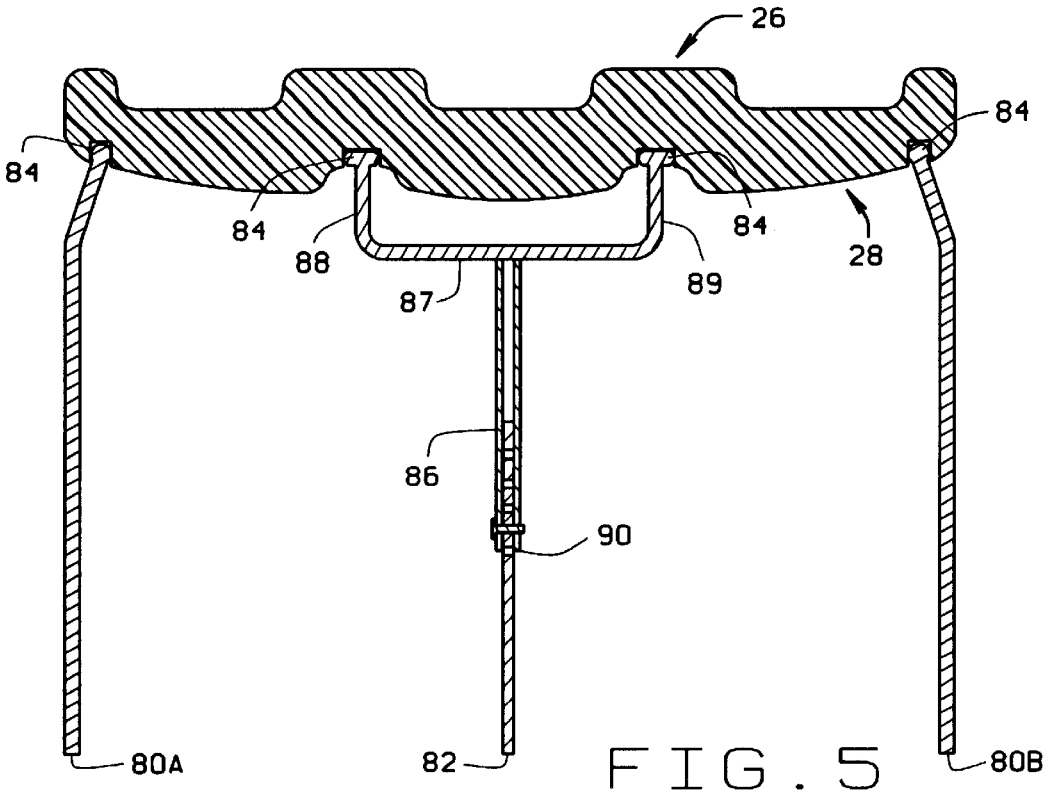
FIG. 5 is a cross-sectional view of the inclined portion and the support legs for the inclined portion of the invention.
Figure 6B:
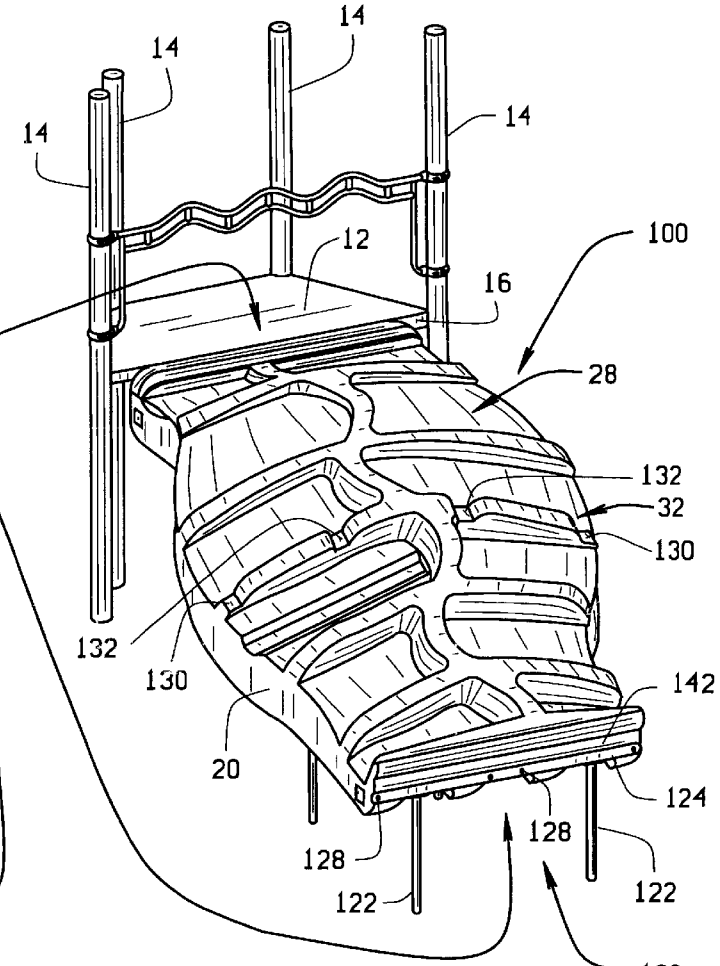
FIG. 6 is also two perspective views of a modified embodiment of the present invention which also illustrates the reversibility of this version of the slide/climber of the present invention.
Figure 6A:
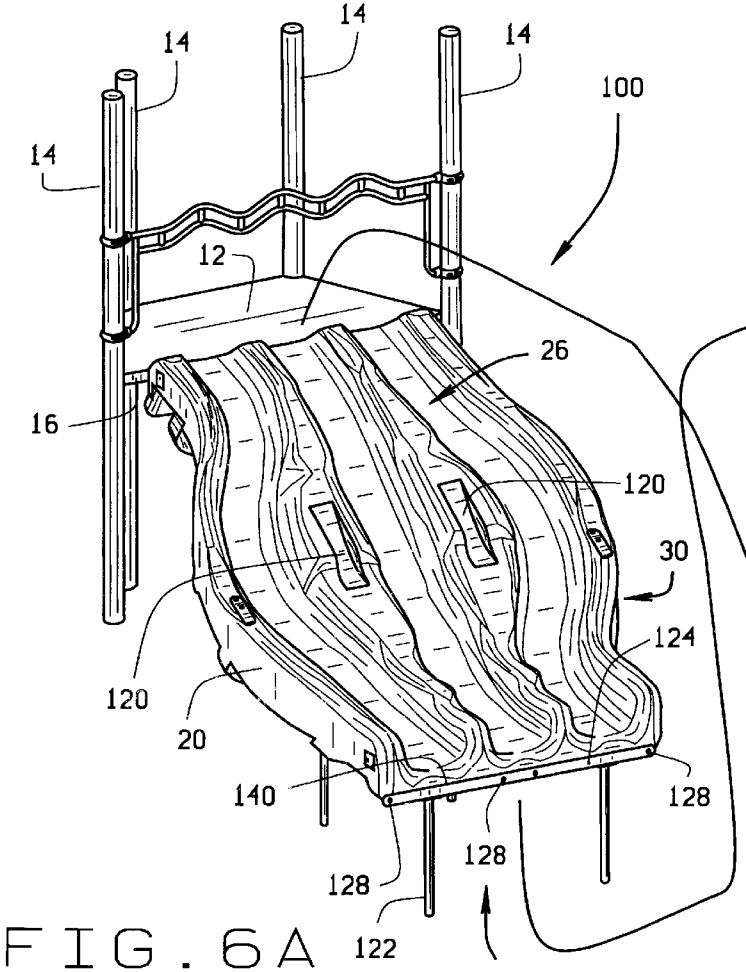
Figure 7:
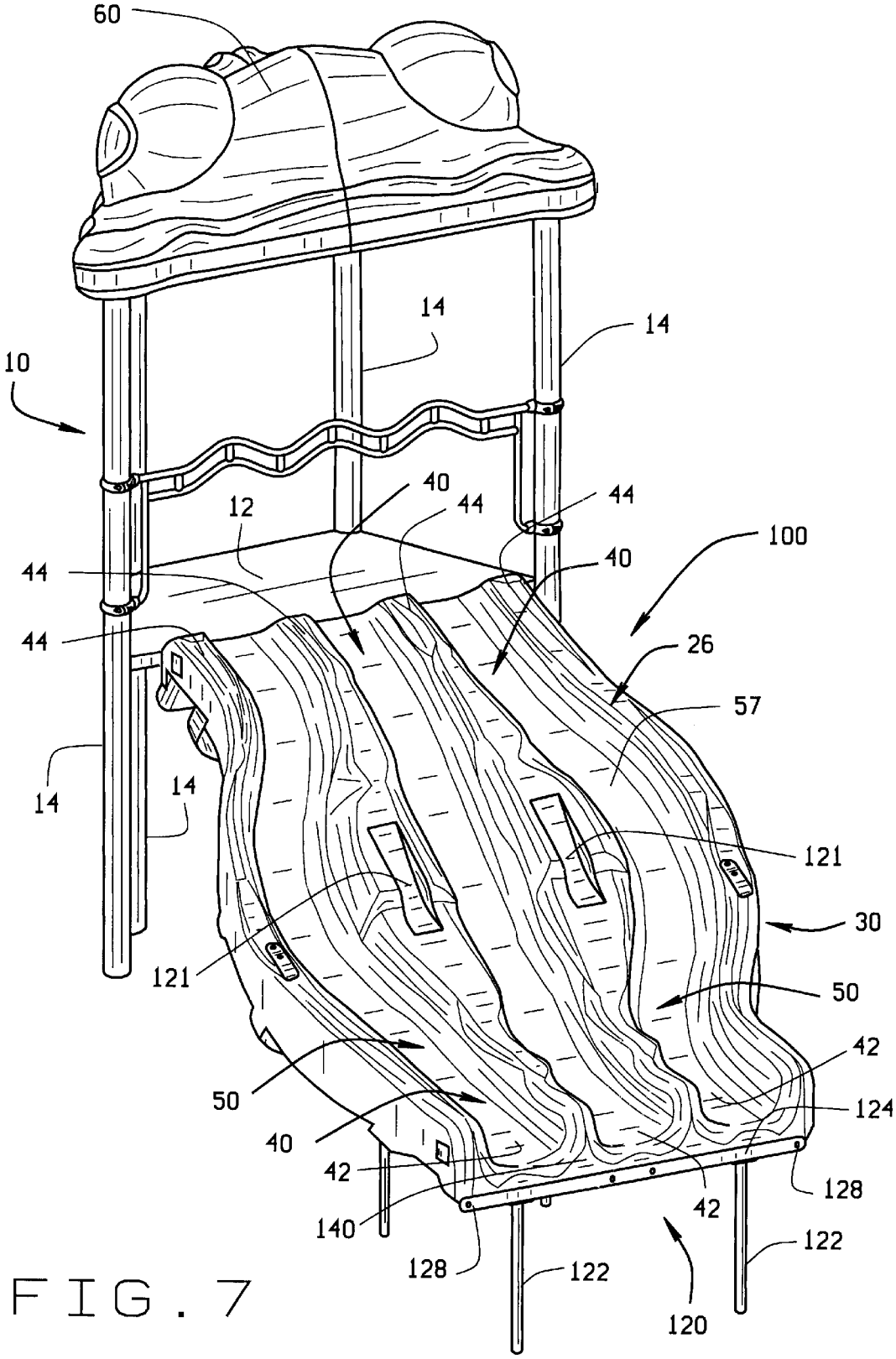
FIG. 7 is an enlarged perspective view illustrating the slider function of the FIG. 6 equipment.
Figure 8:
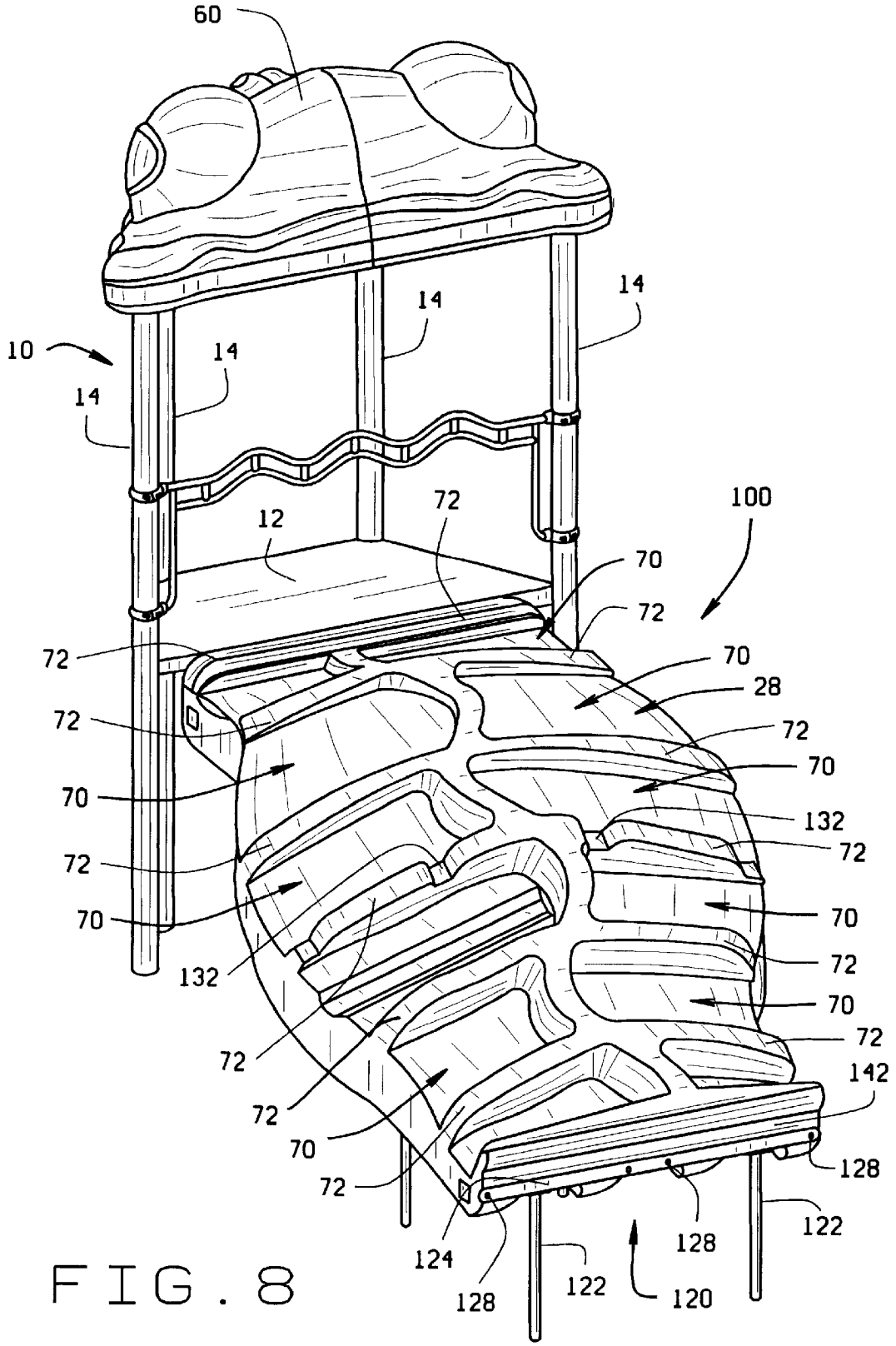
FIG. 8 is an enlarged perspective view of the climber function of the FIG. 6 equipment.

Referring to FIG. 5, the support legs 24 are further depicted supporting the inclined portion 18 having the sliding surface 26 generally facing upward. As can be seen, the support legs 24 fit into the depressions 54 to support and secure the inclined portion 18. The pole 86 of the center stanchion 82 is telescoping, as at 90, as to adjust for the height required, which is determined by which surface of the inclined portion 18, either the sliding 26 or climbing 28, which a user desires to have facing generally upward.

Reference is now made to the FIGS. 6–10 embodiment. As will be apparent, the slide/climber 100 is shown as having the same general shape as slide/climber 10 of the FIGS. 1–5 embodiment including sliding surface 26 and climbing surface 28 and all related components. The essential difference; however, between the FIGS. 1–5 and 6–10 embodiments resides in the use of middle support legs 110 and end support legs 120 in the FIGS. 6–10 embodiment.

Figure 9:
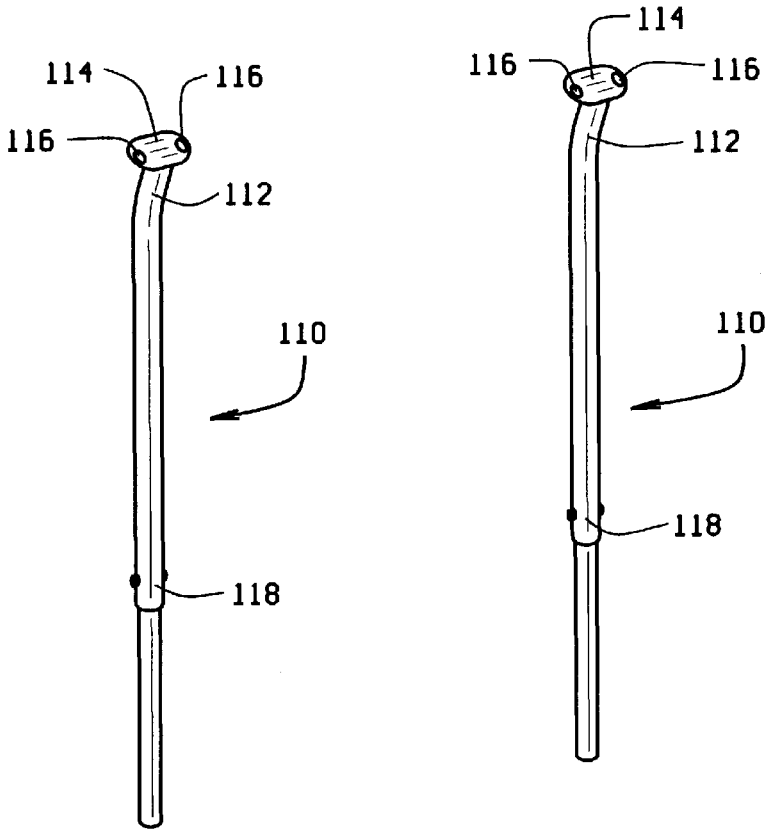
FIG. 9 is a perspective view of the middle legs associated with the FIG. 6 embodiment.
Figure 10:
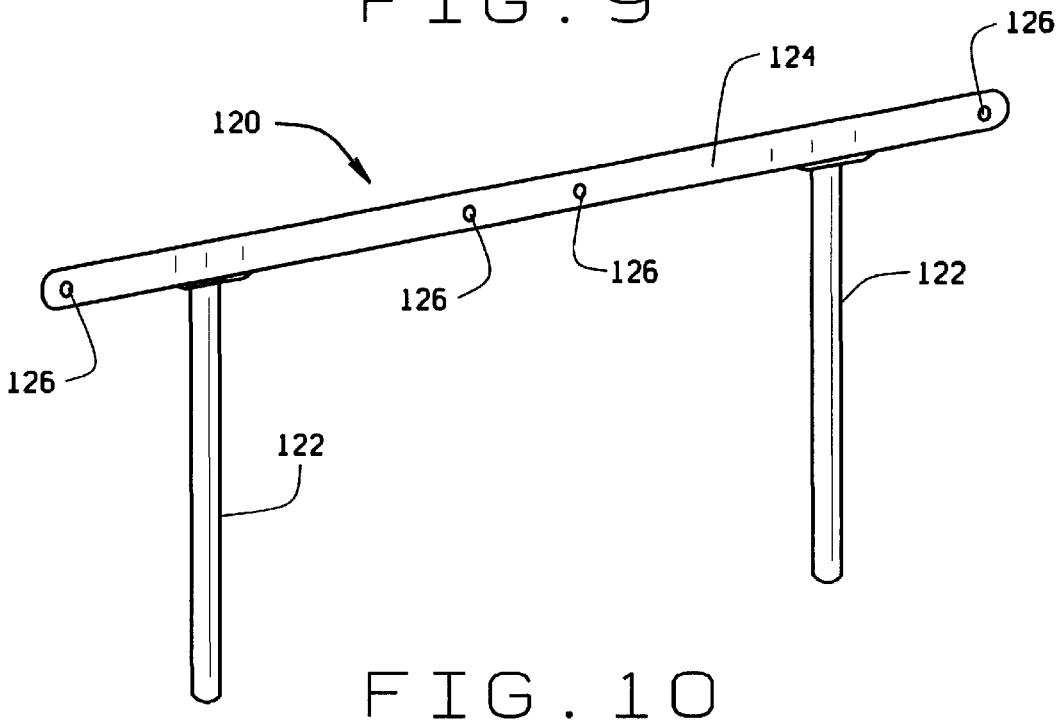
FIG. 10 is a perspective view of the end legs associated with the FIG. 6 embodiment.

Specifically, as shown in FIG. 9, the middle support legs 110 are generally vertical with the upper-most portion 112 slightly angled. At the upper free end of the angled portion 112 is a support plate 114 with suitable openings 116 for receiving fasteners (not shown) to allow direct connection to complementary shaped depressions 121, 121 formed in the inner sidewalls 44, 44 on the sliding surface 26. When turned over to its climbing surface 28, it will be noted that there are two depressions 132 formed on the center-most protrusion 72, in order to allow the pair of middle support legs 110, 110 to be attached to the inner-most pair of depressions 132. Secondly, the sliding surface 26 could also be constructed with an inner-most pair of depressions, if desired. In order to allow the middle-support legs 110, 110 to be attached to the inner-most pair of depressions 132 the middle support legs 110, 110 are preferably telescopically constructed as at 118, 118 for this purpose.

The end support legs 120 include a spaced pair of vertically extending leg supports 122, 122 which are connected to a common elongated and horizontally extending connecting plate 124. The connecting plate 124 has suitable openings 126 (see FIG. 10) for receiving suitable fasteners 128 (see FIGS. 6–8) in order to mount the end legs 120 to the lower-most outer surface 140 on the sliding surface 26 or the lower-most outer surface 142 on the climber surface 28.

Thus, the supporting leg system for the FIGS. 6–10 embodiment, including middle support legs 110 and end support legs 120 differs from the previously described leg supporting system of the FIGS. 1–5 embodiment.

Figure 11B:
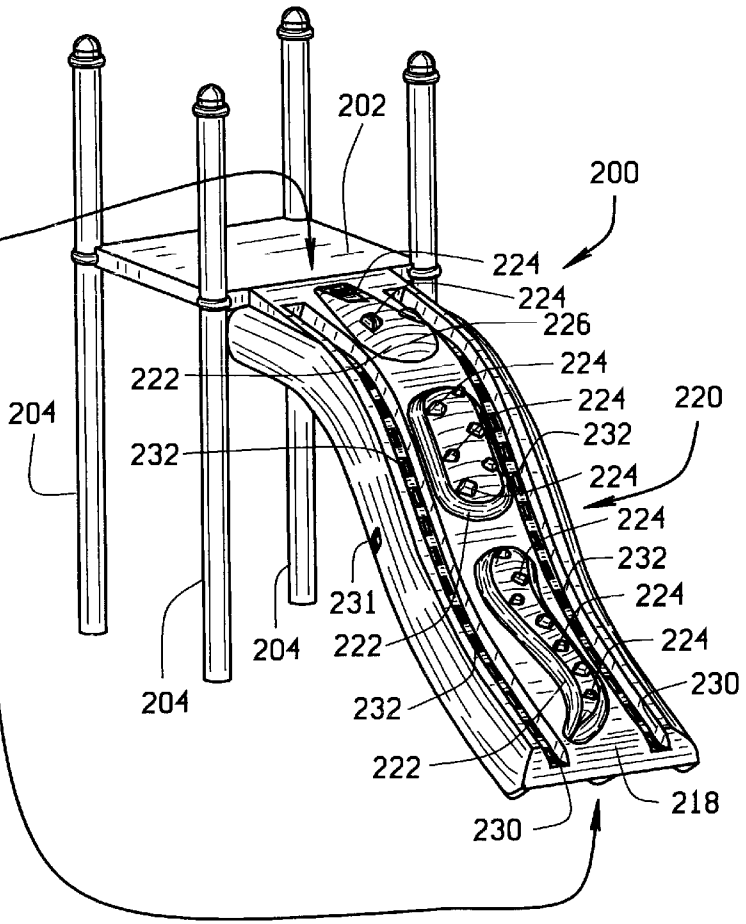
FIG. 11 is also two perspective views of another embodiment of the present invention illustrating the reversibility of this version of the slider/climber of the present invention.
Figure 11A:
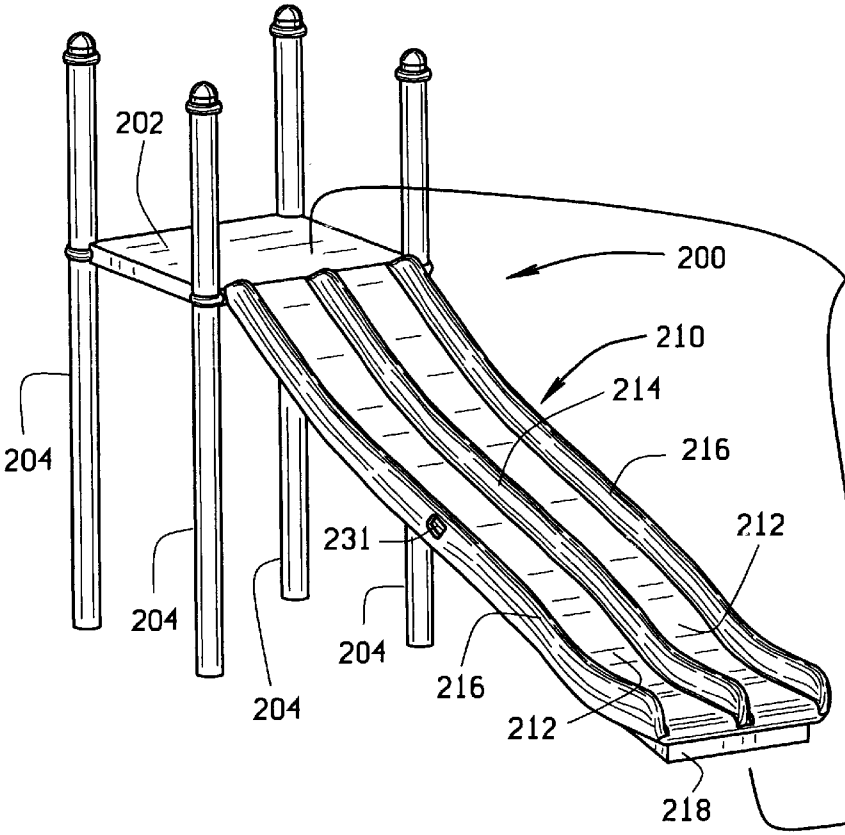
Figure 12:
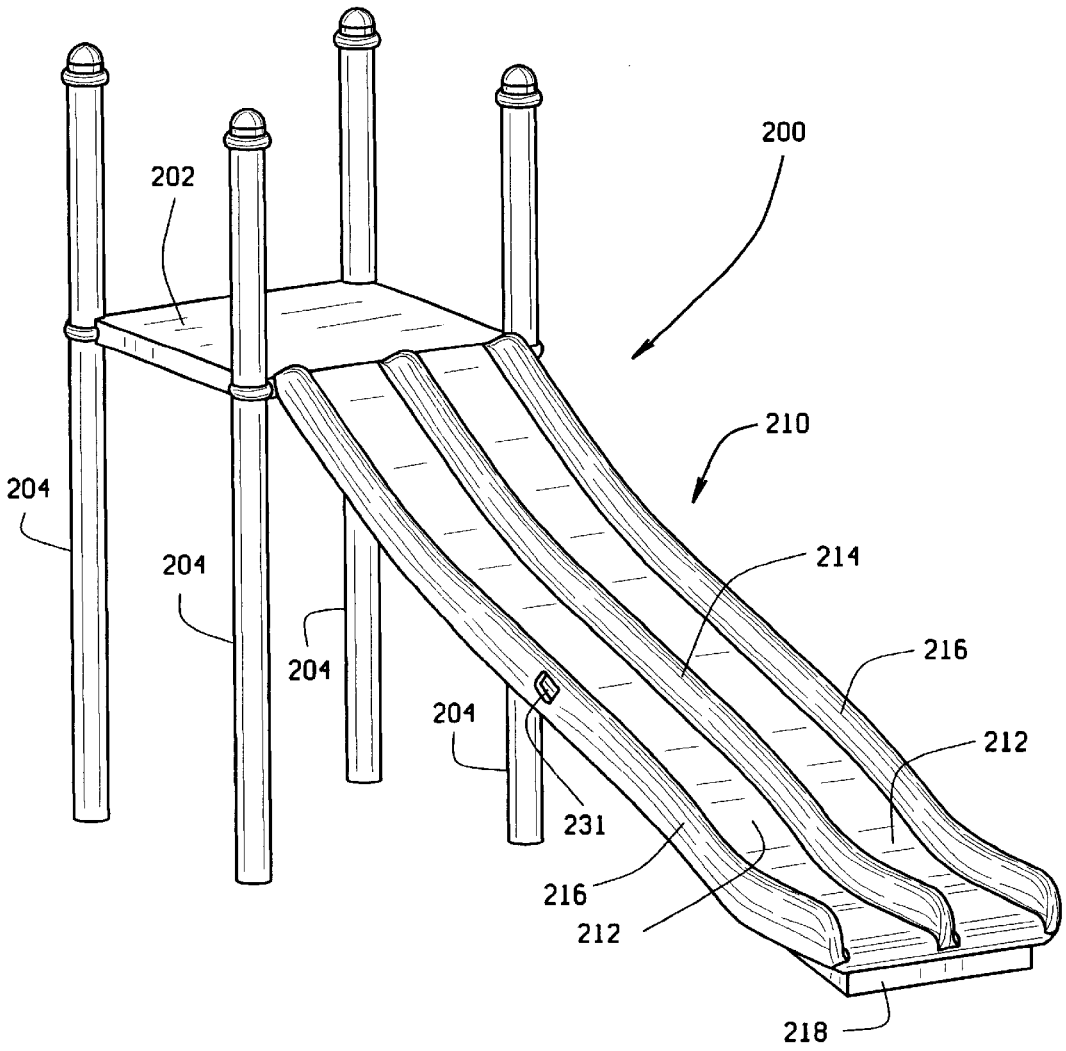
FIG. 12 is an enlarged perspective view illustrating the slider function of the FIG. 11 equipment.
Figure 13:
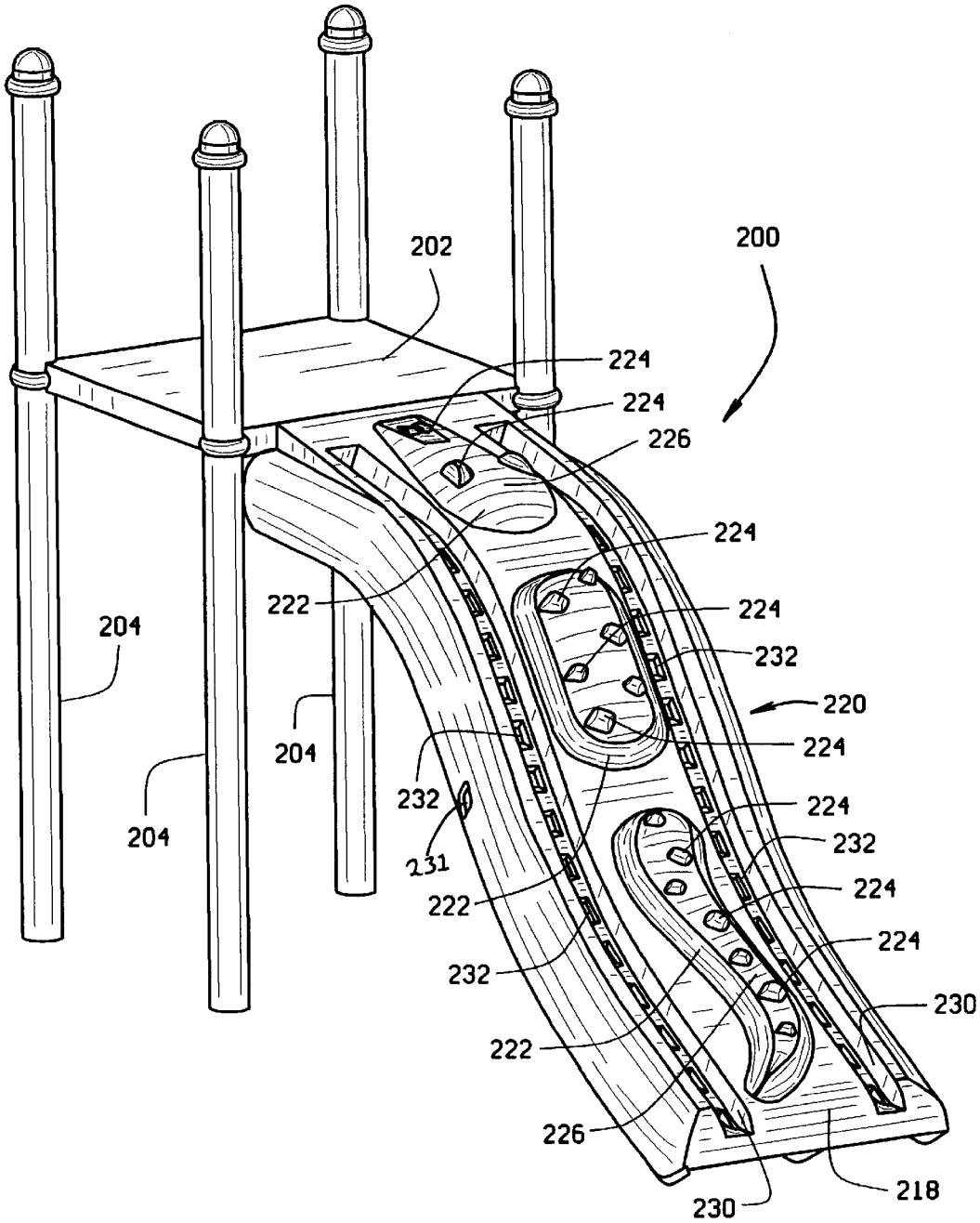
FIG. 13 is an enlarged perspective view illustrating the climber function of the FIG. 11 equipment.

Reference is now made to the reversible slider/climber 200 shown in the FIGS. 11–13 embodiment. In this instance, the reversible slider/climber 200, while maintaining some essential common features, looks entirely differently than the slide/climber of the FIGS. 1–5 embodiment and the slide/climber 110 of the FIGS. 6–10 embodiment.

More specifically, the slide/climber 200 includes a slide 210 and a climber 220. Both the slide 210 and climber 220 extend from the horizontal platform 202, that is supported by the four legs 204, to the ground or supporting surface. Middle support legs will attach to two castings which will attach to the two indentations 231 on the sides.

The slide 210 includes one pair of adjacent slide paths 212 separated from each other by a middle wall 214 of the same height and shape as the two outer sidewalls 216, 216. One or more additional sliding paths of regular or irregular shape may be provided, if desired. It will be noted that the lower-most outer area 218 of the slide 210 attaches to an end support leg. This lower-most outer area 218 of the slide 210 also corresponds to the lower-most outer area 218 of the climber 220, as shown in FIGS. 11–13.

The climber 220 includes a spaced series of irregularly shaped formed areas 222, each of which has closely spaced rock-shaped protrusions 224 extending from its upper surface 226. This allows users to step on the rock-shaped protrusions 224, as well as the irregularly shaped formed areas 222, for climbing the climber 220. In addition, users can climb the climber 220 by stepping in the closely spaced depressions 232 formed in either of the spaced side channels 230 which extend from the top to the bottom of the climber 220.

From the foregoing, it will now be apparent that the three illustrated embodiments of FIGS. 1–5, 6–10 and 11–13 differ from each other in various ways and further variations can be made without departing from the scope of the invention. Thus, all the accompanying drawings and the above description shall be interpreted as illustrative and not in a limiting sense.

In view of the above, it will be seen that the several objects and advantages of the present invention have been achieved and other advantageous results have been obtained.

What is claimed is:

1. A recreational slide/climber for children including:

an elongated body member with generally opposed first and second formed surfaces;

at least one slide provided in said first formed surface;

a climber provided in said second formed surface, said second formed surface being an uneven surface to facilitate climbing by a user; and the elongated body member being reversible so that one or the other of the at least one slide or the climber defines an upper surface of the body member to be used and the other of the at least one slide or the climber defines a lower surface of the body member and which cannot be used, whereby, only one of the at least one slide and the climber can be used at a time.

2. The recreational slide/climber as defined in claim 1 in which there are a plurality of adjacent slides in the first formed surface.

3. The recreational slide/climber as defined in claim 2 in which there are three adjacent slides in the first formed surface.

4. The recreational slide/climber as defined in claim 1 in which the at least one slide surface includes spaced upstanding sidewalls for confining the sliding movement of a user.

5. The recreational slide/climber as defined in claim 4 including a plurality of adjacent slides each having spaced upstanding sidewalls for confining slide movement of a user.

6. The recreational slide/climber as defined in claim 1 in which the uneven surface of said second side defines a series of adjacent steps.

7. The recreational slide/climber as defined in claim 6 in which the adjacent steps include irregularly configured and interconnected steps.

8. The recreational slide/climber as defined in claim 1 including support legs for supporting the slide and climber relative to a ground surface.

9. The recreational slide/climber as defined in claim 8 in which the support legs are detachably connected to the slide and climber.

10. The recreational slide/climber as defined in claim 9 in which the support legs include middle support legs and end support legs.

11. A recreational slide/climber for children including:

an elongated body member with generally opposed formed surfaces;

at least one slide provided in one opposed formed surface;

a climber provided in the other opposed formed surface;

the elongated body member being reversible for use of one or the other of the at least one slide or the climber; and support legs for supporting the slide and climber relative to a ground surface; the support legs being detachably connected to the slide and climber; the support legs include middle support legs and end support legs; at least one of the support legs comprising a telescoping supporting leg to facilitate mounting the slide or climber in position for use.

12. A recreational slide/climber for children including:

an elongated body member with generally opposed first and second formed surfaces;

a plurality of adjacent slides provided in the first formed surface, each slide having spaced upstanding sidewalls for confining the sliding movement of a user;

a climber provided in the second formed surface, the climber having a series of adjacent steps to facilitate climbing by a user; and the elongated body member being reversible and mountable to an elevated platform if the body member is mounted to the platform in a first manner one of the adjacent slides and the climber defines an upper surface of the body member to be used, and if the body member is mounted to the platform in a second manner the other of the adjacent slides and the climber defines the upper surface of the body member to be used, whereby, only one of the adjacent slides and the climber can be used at a time.

13. The recreational slide/climber as defined in claim 12 in which there are three adjacent slides in a pre-configured and formed shape.

14. The recreational slide/climber as defined in claim 13 in which the adjacent steps include irregularly configured and interconnected steps.

15. A recreational slide/climber for children including:

an elongated body member formed from plastic material with generally opposed first and second formed surfaces;

a plurality of adjacent slides having a pre-configured shape provided in said first formed surface, each slide having spaced upstanding sidewalls integral with each slide for confining the sliding movement of a user;

a climber provided in the second formed surface, the climber having a series of adjacent and interconnected formed steps to facilitate climbing by a user;

the elongated body member being reversible so that one or the other of the adjacent slides or climber defines an upper surface of the body member to be used and the other of the adjacent slides or the climber defines a lower surface of the body member and which cannot be used, whereby, only one of the adjacent slides and the climber can be used at a time; and the elongated body member being mounted at an angle to a supporting surface to expose either the adjacent slides or climber for use.

16. The recreational slide/climber as defined in claim 15 in which the elongated body is mounted to the supporting surface by leg elements.

17. A recreational slide/climber for children including:

an elongated body member formed from plastic material with generally opposed formed surfaces;

a plurality of adjacent slides having a pre-configured shape provided in one opposed formed surface, each slide having spaced upstanding sidewalls integral with each slide for confining the sliding movement of a user;

a climber provided in the generally opposed formed surface, the climber having a series of adjacent and interconnected formed steps to facilitate climbing by a user;

the elongated body member being reversible for use of one or the other of the adjacent slides or climber; and the elongated body member being mounted at an angle to a supporting surface by leg elements to expose either the adjacent slides or climber for use; at least one of the leg elements being telescopically constructed.

18. The recreational slide/climber as defined in claim 17 in which the leg elements are removably mounted to either the spaced upstanding sidewalls of the slide or to interconnected protrusions of the interconnected formed steps of the climber.

19. A playground assembly comprising;

an elevated platform and;

an elongated body member extending from said platform and sloping downwardly towards the ground; said body member having:

first and second generally opposed formed surfaces and first and second ends; each of said first and second ends being adapted for connection to said platform surface;

at least one slide provided in said first formed surface; and a climber provided in the said second formed surface; said second formed surface being an irregular surface to facilitate climbing of said climber by a user;

the elongated body member being reversible so that one or the other of the first and second opposed surfaces of said body member defines an upper surface of the body member to be used and the other of the first and second opposed surfaces defines a lower surface of the body member facing said surface; wherein, when said first opposed surface is said upper surface, said body member first end is connected to said platform; and when said second opposed surface is said upper surface, said body member second end is connected to said platform.

20. The playground assembly of claim 19 including at least one support member extending downwardly from said body member; said body member including at least one mounting surface to which said at least one support member is connected.

21. The playground assembly of claim 20 wherein said at least one mounting surface comprises at least one depression.

22. The playground assembly of claim 20 wherein at least one mounting surface is formed in both said first and second opposed surfaces of said body member.

* * * * *